US011854756B2

(12) United States Patent
Jia et al.

(10) Patent No.: US 11,854,756 B2
(45) Date of Patent: Dec. 26, 2023

(54) TWO-PART SOLENOID PLUNGER

(71) Applicant: Suzhou Littelfuse OVS Co., Ltd., Suzhou (CN)

(72) Inventors: Yanqiu Jia, Suzhou (CN); Dan Jin, Suzhou (CN); Du Cheng, Suzhou (CN)

(73) Assignee: Suzhou Littelfuse OVS Co., Ltd., Suzhou (CN)

( * ) Notice: Subject to any disclaimer, the term of this patent is extended or adjusted under 35 U.S.C. 154(b) by 0 days.

(21) Appl. No.: 17/628,044

(22) PCT Filed: Jul. 16, 2019

(86) PCT No.: PCT/CN2019/096142
§ 371 (c)(1),
(2) Date: Jan. 18, 2022

(87) PCT Pub. No.: WO2021/007770
PCT Pub. Date: Jan. 21, 2021

(65) Prior Publication Data
US 2022/0262589 A1 Aug. 18, 2022

(51) Int. Cl.
*H01H 50/18* (2006.01)
*H01H 50/44* (2006.01)
*H01H 71/24* (2006.01)

(52) U.S. Cl.
CPC ..... *H01H 50/18* (2013.01); *H01H 50/44* (2013.01); *H01H 71/2463* (2013.01)

(58) Field of Classification Search
CPC ..... H01H 50/18
USPC ..... 335/255, 131, 126
See application file for complete search history.

(56) References Cited

U.S. PATENT DOCUMENTS 2,303,442 A * 12/1942 Draper ..... H01H 50/20 335/239
2,919,324 A * 12/1959 Schuessler ..... H01H 51/12 335/85
3,027,772 A * 4/1962 Smith ..... F16H 25/186 335/228
3,136,930 A * 6/1964 Straub ..... H01F 7/145 310/23
3,225,159 A * 12/1965 Myrent ..... H01H 51/065 335/126

(Continued)

FOREIGN PATENT DOCUMENTS

WO 2014023326 A1 2/2014
WO 2014123326 A1 8/2014

OTHER PUBLICATIONS

International Search Report and Written Opinion dated Apr. 22, 2020 for PCT/CN2019/096142 filed Jul. 16, 2019.

*Primary Examiner* — Alexander Talpalatski
(74) *Attorney, Agent, or Firm* — KDW Firm PLLC

(57) ABSTRACT

Provided herein is an improved solenoid electrical switch. In some embodiments, a solenoid electrical switch may include a plunger at least partially disposed in a central aperture of a solenoid for rotation and axial reciprocation between at least two positions into and out of the central aperture relative to a magnetic coupling member. The plunger may include a first component including a main body and a central slot within the main body, and a second component at least partially disposed within the central slot, wherein the second component may include an engagement surface engaged with an inner surface of the central slot.

14 Claims, 2 Drawing Sheets

(56) References Cited

U.S. PATENT DOCUMENTS

| | | | | |
|---|---|---|---|---|
| 3,264,530 | A * | 8/1966 | Leland | H02K 7/065 74/99 R |
| 4,470,030 | A * | 9/1984 | Myers | H01F 7/145 335/228 |
| 4,644,179 | A * | 2/1987 | Pointout | B60K 28/14 335/131 |
| 4,896,699 | A * | 1/1990 | Shimamura | H01F 7/1607 335/262 |
| 8,344,832 | B2 * | 1/2013 | Lee | H01H 51/065 335/131 |
| 8,841,979 | B2 * | 9/2014 | Uchida | H01H 53/02 335/131 |
| 9,013,253 | B2 * | 4/2015 | Uchida | H01H 50/546 335/131 |
| 10,199,192 | B2 * | 2/2019 | Beauregard | H01H 49/00 |
| 2016/0189900 | A1 * | 6/2016 | Beauregard | H01F 7/1615 335/170 |
| 2017/0207641 | A1 * | 7/2017 | Schmidt | B60L 3/12 |

* cited by examiner

TWO-PART SOLENOID PLUNGER

FIELD

The disclosure relates generally to the field of circuit protection devices and, more particularly, to a two-part solenoid plunger.

BACKGROUND

An electrical relay is a device that enables a connection to be made between two electrodes in order to transmit a current. Some relays include a coil and a magnetic switch. When current flows through the coil, a magnetic field is created proportional to the current flow. At a predetermined point, the magnetic field is sufficiently strong to pull the switch's movable contact from its rest, or de-energized position, to its actuated, or energized position pressed against the switch's stationary contact. When the electrical power applied to the coil drops, the strength of the magnetic field drops, releasing the movable contact and allowing it to return to its original de-energized position. As the contacts of a relay are opened or closed, there is an electrical discharge called arcing, which may cause heating and burning of the contacts and typically results in degradation and eventual destruction of the contacts over time.

A solenoid is a specific type of high-current electromagnetic relay. Solenoid operated switches are widely used to supply power to a load device in response to a relatively low level control current supplied to the solenoid. Solenoids may be used in a variety of applications. For example, solenoids may be used in electric starters for ease and convenience of starting various vehicles, including conventional automobiles, trucks, lawn tractors, larger lawn mowers, and the like.

Solenoids include a plunger operable to open or close the switch depending upon a position of the plunger. Plungers are driven by power and pulse and perform the action of advancing and returning movement. Conventional plungers are designed as a single part from a high magnetic material, such as AISI 1215 carbon steel, and riveted with a washer. However, conventional plungers are prone to fail earlier than desired, for example, less than approximately 30,000 cycles.

Thus, a need exists for a more robust solenoid plunger that can withstand a higher number of cycles. It is with respect to these and other considerations that the present improvements are provided.

SUMMARY

In one approach according to the present disclosure, a solenoid electrical switch may include a solenoid bobbin forming a solenoid by being wound with coil windings, the solenoid bobbin having a central aperture defined therein, and the coil windings, which when engaged by a power source, generates a magnetic field, the solenoid bobbin having a top portion including vertically extending contacts spaced apart to define a trench. The solenoid electrical switch may further include a magnetic coupling member mounted on the solenoid and disposed in the trench and proximate to the vertically extending contacts of the solenoid bobbin, the magnetic coupling member surrounding at least a portion of the central aperture. The solenoid electrical switch further including a plunger at least partially disposed in the central aperture for rotation and axial reciprocation between at least two positions into and out of the central aperture relative to the solenoid and the magnetic coupling member. The plunger may include a first component including a main body and a central slot within the main body, and a second component at least partially disposed within the central slot, the second component including an engagement surface engaged with an inner surface of the central slot.

In another approach according to the present disclosure, a plunger of a solenoid may include a first component including a main body and a central slot within the main body, and a second component at least partially disposed within the central slot, the second component including an engagement surface mechanically engaged with an inner surface of the central slot.

In yet another approach according to the present disclosure, a solenoid electrical switch may include a solenoid bobbin forming a solenoid by being wound with coil windings, the solenoid bobbin having a central aperture defined therein, and the coil windings, which when engaged by a power source, generates a magnetic field, the solenoid bobbin having a top portion including vertically extending contacts spaced apart to define a trench. The solenoid electrical switch may further include a magnetic coupling member mounted on the solenoid and disposed in the trench and proximate to the vertically extending contacts of the solenoid bobbin, the magnetic coupling member surrounding at least a portion of the central aperture. The solenoid electrical switch may further include a plunger extending into the central aperture, the plunger operable to rotate and move axially along a plunger axis between at least two positions. The plunger may include a first component including a main body and a central slot within the main body, and a second component extending into the central slot, wherein the second component includes an engagement surface mechanically engaged with an inner surface of the central slot, wherein the second component includes a first section connected with a second section, and wherein a width of the second section is greater than a width of the first section. The plunger may further include an end cap coupled to a first end of the second component.

BRIEF DESCRIPTION OF THE DRAWINGS

The accompanying drawings illustrate exemplary approaches of the disclosed embodiments so far devised for the practical application of the principles thereof, and in which.

Figure 1:
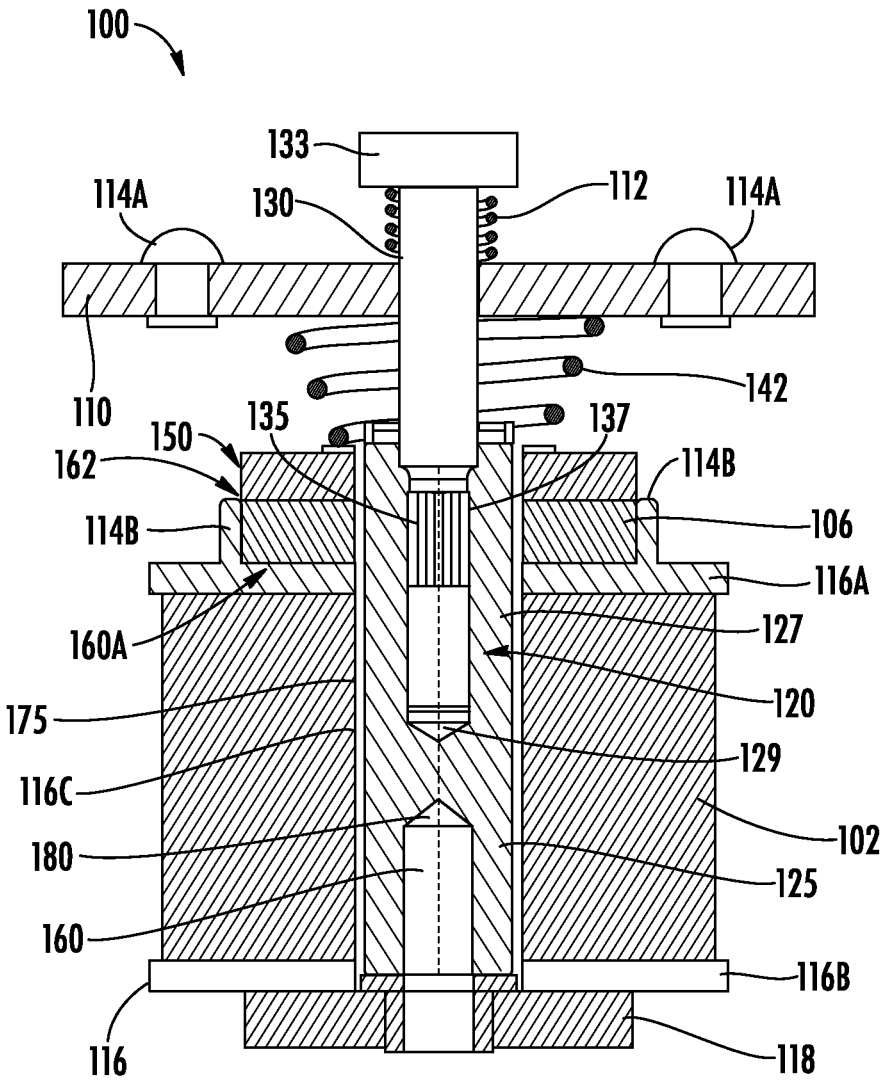
FIG. 1 depicts a side cross-sectional view of an electrical solenoid switch according to embodiments of the present disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION OF ILLUSTRATIVE EMBODIMENTS

Embodiments in accordance with the present disclosure will now be described more fully hereinafter with reference to the accompanying drawings. The embodiments herein may be described in many different forms and should not be construed as limiting. Rather, these embodiments are provided so that this disclosure will be thorough and complete, and will fully convey the scope of the system and method to those skilled in the art.

As will be described herein, embodiments of the present disclosure are directed to an improved solenoid electrical switch. In some embodiments, a solenoid electrical switch may include a plunger at least partially disposed in a central aperture of a solenoid for rotation and axial reciprocation between at least two positions into and out of the central aperture relative to a magnetic coupling member. The plunger may include a first component including a main body and a central slot within the main body, and a second component at least partially disposed within the central slot, wherein the second component may include an engagement surface engaged with an inner surface of the central slot.

Unlike prior art plungers, embodiments herein are directed to a plunger separated into two parts, wherein the first component may be made from a magnetic material, such as AISI 1215 carbon steel. The second component may be made from stainless steel, such as SUS301, which is riveted with a washer. Furthermore, the second component may receive a knurling treatment at a connection area between the first and second components. Thus, the improved plunger design herein provides sufficient plunger magnetic performance along with increased performance due to the robust interface connection.

Turning now to FIG. 1, an exemplary electrical solenoid switch (hereinafter "switch") 100 in accordance with the present disclosure will be described. The switch 100, such as, for example, a bi-stable electrical solenoid switch, includes a solenoid bobbin 116 (e.g., a solenoid bobbin housing). The solenoid bobbin 116 may be formed within a solenoid body 150 with coil windings 102 wound around the solenoid bobbin 116. The solenoid bobbin 116 may have a body or connection piece 116C, which includes a top section 116A (e.g., a first end) connected to a bottom section 116B (e.g., a second end) via the connection piece 116C. In some embodiments, a solenoid shroud (not shown) surrounds and protects the coil windings 102. The connection piece 116C may be defined in one of multiple geometric configurations. For example, the connection piece 116C may be a circular pipe shaped having a predetermined thickness and predetermined diameter. The solenoid body 150, or more specifically the solenoid bobbin 116, includes a central aperture 175 defined therein, and the coil windings 102, which when engaged by a power source, generate a magnetic field. More specifically, the central aperture 175 may be formed within the connection piece 116C.

The solenoid body 150 also includes a solenoid frame 118 disposed beneath the solenoid bobbin 116 for additional support and protection of the solenoid body 150. The solenoid body 150 may include an iron core 160 positioned inside the central aperture 175. A compression spring 180 may be disposed on the iron core 160 to create a buffer and shock absorber between the plunger 120 and the iron core 160. The compression spring 180 may also be composed of a conductive material.

In some embodiments, the top section 116A of the solenoid bobbin 116 includes electric contacts 114B, which may be one or more vertically extending electrical contacts, spaced a distance away from one another to define a trench 162. As shown, the trench 162 may extend from the at least two vertically extending electric contacts 114B and the connection piece 116C. In one non-limiting example, the electric contacts 114B are silver alloy contacts. A magnetic coupling member 106, such as a magnet, may be mounted on the solenoid body 150. As shown, the magnetic coupling member 106 may extend horizontally and/or vertically within the trench 162, proximate the electric contacts 114B. The magnetic coupling member 106 may surround at least a portion of the central aperture 175 and the connection piece 116C.

As further shown, the switch 100 may include a plunger 120 at least partially disposed in the central aperture 175 of the solenoid bobbin 116 for rotation and axial reciprocation between at least two positions into and out of the central aperture 175 relative to the solenoid body 150 and the magnetic coupling member 106. As will be described in greater detail below, the plunger 120 may include a first component 125 including a main body 127 and a central slot 129 within the main body 127. The plunger 120 may further include a second component 130 at least partially disposed within the central slot 129 of the first component 125. As shown, the second component 130 may include an engagement surface 135 engaged with an inner surface 137 of the central slot 129 of the first component 125. As further shown, the second component 130 may be coupled to a conductive plate 110 (e.g., an input conductive plate), such as a movable bus bar. The plunger 120 is magnetically attracted towards the magnetic coupling member 106.

The conductive plate 110 is coupled to the plunger 120 and provided with one or more electric contacts 114A on each end of the conductive plate 110. The conductive plate 110 may be configured to electrically engage and disengage the solenoid body 150 upon respective application of power to the solenoid body 150. In some embodiments, the electrical contacts 114B are configured for electrically engaging and disengaging the electric contacts 114A for opening (e.g., powering off) and closing (e.g., powering on) the switch 100.

During operation, the magnetic field latches and unlatches the plunger 120 between at least two positions. The magnetic coupling member 106 is configured to reduce the force necessary by the magnetic field for allowing the solenoid body 150 to remain in the open position when selectively energized for operating in a constant current mode for allowing a wide operating voltage and reduced operating power. The magnetic coupling member 106 retains the plunger 120 in one of the at least two positions. The constant current mode allows for a multi-stage peak-an-hold current. Although non-limiting, the wide operating voltage is within a range of 5 to 32 volts.

The conductive plate 110, the coil windings 102, the electric contacts 114A and 114B, and the plunger 120 may be formed of any suitable, electrically conductive material, such as copper or tin, and may be formed as a wire, a ribbon, a metal link, a spiral wound wire, a film, an electrically conductive core deposited on a substrate, or any other suitable structure or configuration for providing a circuit interrupt. The conductive materials may be decided based on fusing characteristic and durability. In some embodiments, the first component 125 of the plunger 120 is a steel material and may include stainless steel caps covering the electric contacts 114A and the electric contacts 114B and/or may be positioned on each end of the conductive plate 110. The electric contacts 114A and the electric contacts 114B may also be stainless steel. Meanwhile, the second component 130 of the plunger 120 may be made from a carbon steel.

As further shown, the electric contacts 114B electrically engage electric contacts 114A when power to the switch 100 is provided. The conductive plate 110 may move as a result of the magnetic field generated in the coil windings 102 and the magnetic coupling member 106. The switch 100 may also include a first spring 142, such as a return spring, disposed between the magnetic coupling member 106 and the conductive plate 110. A retaining device (not shown), such as a washer riveted onto the solenoid, may be disposed between the magnetic coupling member 106 and the first spring 142. The first spring 142 may create a hammer effect to break the connection between the electric contacts 114A and electric contacts 114B when power to the switch 100 is removed. The first spring 142 may be configured to overcome the force of the magnetic coupling member 106 necessary to retain the conductive plate 110, which is energized, in the engaged position with solenoid body 150 so that the switch 100 may be in the open position. The first spring 142 displaces the plunger 120 back to an alternative one of the at least two positions when the power source is disengaged from the solenoid body 150. By displacing the plunger 120, the first spring 142 overcomes the force of the magnetic coupling member 106, and the conductive plate 110 disengages the solenoid body 150.

As further shown, the switch 100 may include a second spring 112, such as an over travel spring, disposed between the conductive plate 110 and a top portion of the magnetic coupling member 106. The second spring 112 prevents the conductive plate 110 from traveling a distance that causes the conductive plate 110 to hit or make contact with an end cap 133 (e.g., a washer) of the plunger 120. In some embodiments, the first and second springs 142, 112 assist in securing the conductive plate 110 to the plunger 120 in a fixed and/or adjustable position. For example, the first spring 142, together with the second spring 112, is positioned such that the force of the first spring 142 pushing up from beneath the conductive plate 110 and the force of the second spring 112 pushing down from above the conductive plate 110 prevent the conductive plate 110 from bending and becoming non-parallel relative to the magnetic coupling member 106.

Although not shown, the switch 100 may be connected to a circuit. For example, a controller, such as printed circuit board assembly (PCBA) controller, may be configured to receive the switch 100 to provide electrical connection between the switch 100, a power source, and other circuitry. An electrical connection may be provided for providing power to the switch 100. More specifically, the coil windings 102 may be connected to the controller.

Figure 2:
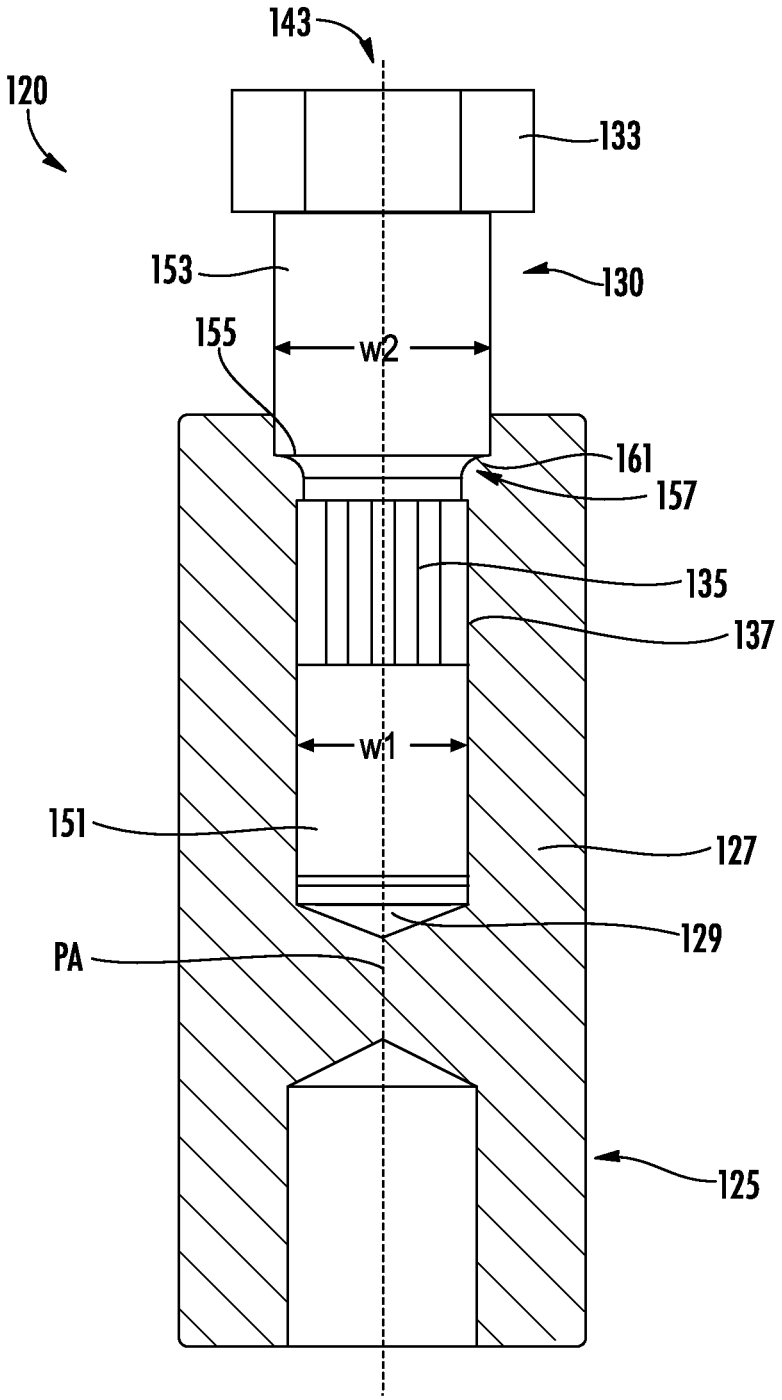
FIG. 2 depicts a side cross-sectional view of a plunger of the electrical solenoid switch of FIG. 1 according to embodiments of the present disclosure.

Turning now to FIG. 2, the plunger 120 according to embodiments of the present disclosure will be described in greater detail. As shown, the plunger 120 includes the first component 125 connected with the second component 130, wherein the first component 125 includes the main body 127 including the central slot 129 formed therein. In some embodiments, the main body 127 and the central slot 129 are symmetrical aligned about a plunger axis, 'PA'. Once engaged, the second component 130 may be partially disposed within the central slot 129 such that the engagement surface 135 is in direct physical contact with the inner surface 137 of the central slot 129. As shown, the engagement surface 135 may include a knurled surface pattern formed along an external surface 141 of the second component 130. Although non-limiting, the engagement surface 135 may extend circumferentially around the second component 130.

Furthermore, although shown as a series of vertically oriented surface features, it will be appreciated that the knurled surface pattern may be oriented horizontally, diagonally, and/or vertically. As stated above, the first component 125 may be made from a magnetic material, such as AISI 1215 carbon steel, while the second component 130 may be made from stainless steel, such as SUS301. Other materials are possible within the scope of the present disclosure, however.

As further shown, the plunger may include the end cap 133 coupled to a first end 143 of the second component 130. In some embodiments, the end cap 133 is a washer, which is riveted to the first end 143 of the second component 130. Embodiments are not limited in this context, however.

In some embodiments, the second component 130 may include a first section 151 having a first width 'w1' and a second section 153 having a second width 'w2.' As shown, w2 may be greater than w1. Furthermore, the second component 130 may include a shoulder region 155 between the first section 151 and the second section 153, wherein the shoulder region 155 engages a surface projection 157 along the inner surface 137 of the central slot 129. As shown, the surface projection 157 may include a ledge 161 extending towards the plunger axis, 'PA'. The increased width of the second section 153, along with the shoulder region 155, which is operable to engage the surface projection 157, provides a more robust interface for the plunger 120. Accordingly, after a high amount of repeated cycles, the plunger 120 is less likely to fail.

With reference to FIGS. 1-2, an example of the behavior of the switch 100 may be explained as follows. As the electromagnetic coil windings 102 are connected to the controller, the plunger 120, which has been held in an uppermost position (e.g., a first position) by the actions of the first spring 142, will be forced to move downwardly within the central aperture 175, while compressing the first spring 142. The downward movement is a result of a magnetic force generated within the coil windings 102, which have been energized from a constant current mode operation. Because the plunger 120 is magnetically attracted to the magnetic coupling member 106, the magnetic coupling member 106 reduces the overall amount of the magnetic force necessary for creating the downward movement of the plunger 120, retaining the plunger 120 in a closed position. In the closed position, the electric contacts 114A mutually touch the solenoid conductive contacts, such as the electric contacts 114B, in the first position, such as a closed or "powered on" position.

Then, as the supply of the constant current to the coil windings 102 is suspended, the plunger 120 will be forced to return to its initial position (e.g., the first position) by the restoring forces of the first spring 142 applied to the plunger 120, while simultaneously overcoming the magnetic attraction of the plunger 120 to the magnetic coupling member 106. The electric contacts 114A are disengaged from the solenoid conductive contacts, such as the electric contacts 114B, in the second position. The second position may be an open or "powered off" position, wherein the plunger 120 is forced to return to its initial position by the restoring forces of the first spring 142 applied to the plunger 120.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

Still furthermore, although the illustrative methods are described above as a series of acts or events, the present disclosure is not limited by the illustrated ordering of such acts or events unless specifically stated. For example, some acts may occur in different orders and/or concurrently with other acts or events apart from those illustrated and/or described herein, in accordance with the disclosure. In addition, not all illustrated acts or events may be required to implement a methodology in accordance with the present disclosure. Furthermore, the methods may be implemented in association with the formation and/or processing of structures illustrated and described herein as well as in association with other structures not illustrated.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes.

What is claimed is:

1. A solenoid electrical switch, comprising:

a solenoid bobbin forming a solenoid by being wound with coil windings, the solenoid bobbin having a central aperture defined therein, and the coil windings, which when engaged by a power source, generates a magnetic field, the solenoid bobbin having a top portion including vertically extending contacts spaced apart to define a trench;

a magnetic coupling member mounted on the solenoid and disposed in the trench and proximate to the vertically extending contacts of the solenoid bobbin, the magnetic coupling member surrounding at least a portion of the central aperture; and a plunger at least partially disposed in the central aperture for rotation and axial reciprocation between at least two positions into and out of the central aperture relative to the solenoid and the magnetic coupling member, the plunger comprising:

a first component including a main body and a central slot within the main body; and a second component at least partially disposed within the central slot, the second component including an engagement surface engaged with an inner surface of the central slot, wherein second component further includes a shoulder region between a first section and a second section, wherein the engagement surface comprises a knurled surface pattern immediately below the shoulder region, wherein the first component is made from a carbon steel, wherein the second component is made from stainless steel, and wherein the stainless steel is in contact with a conductive plate having at least one contact.

2. The solenoid electrical switch of claim 1, further comprising an end cap coupled to a first end of the second component, wherein a second end of the second component is disposed within the central slot.

3. The solenoid electrical switch of claim 1, the second component comprising:

the first section having a first width;

the second section extending from the first section, the second section having a second width different than the first width.

4. The solenoid electrical switch of claim 3, wherein the shoulder region engages a surface projection along the inner surface of the central slot.

5. The solenoid electrical switch of claim 1, wherein the conductive plate has a first end opposite a second end, the conductive plate coupled to the plunger and having the at least one contact disposed on each of the first and second ends of the conductive plate, wherein the conductive plate is configured to electrically engage and disengage the solenoid upon respective application of power to the solenoid, the magnetic field latching and unlatching the plunger between the at least two positions for engaging and disengaging the contacts of the conductive plate and the vertically extending contacts of the solenoid bobbin.

6. The solenoid electrical switch of claim 5, further comprising a first spring configured to receive the plunger, wherein the first spring is disposed between the magnetic coupling member and the conductive plate, and wherein the first spring is configured to overcome a force of the magnetic coupling member necessary to retain the solenoid in an open position and displacing the plunger back to an alternative one of the at least two positions when the power source is disengaged from the solenoid.

7. The solenoid electrical switch of claim 1, wherein the plunger is magnetically attracted towards the magnetic coupling member.

8. A plunger of a solenoid, comprising:

a first component including a main body and a central slot within the main body; and a second component at least partially disposed within the central slot, the second component including an engagement surface mechanically engaged with an inner surface of the central slot, wherein second component further includes a shoulder region between a first section and a second section, and wherein the engagement surface comprises a knurled surface pattern immediately below the shoulder region, wherein the first component is made from a carbon steel, wherein the second component is made from stainless steel, and wherein the stainless steel is in contact with a conductive plate having at least one contact.

9. The plunger of claim 8, the second component comprising:

the first section having a first width; and the second section extending from the first section, wherein the second section has a second width different than the first width, and wherein the second width is greater than the first width.

10. The plunger of claim 9, wherein the shoulder region engages a surface projection along the inner surface of the central slot.

11. A solenoid electrical switch, comprising:

a solenoid bobbin forming a solenoid by being wound with coil windings, the solenoid bobbin having a central aperture defined therein, and the coil windings, which when engaged by a power source, generates a magnetic field, the solenoid bobbin having a top portion including vertically extending contacts spaced apart to define a trench;

a magnetic coupling member mounted on the solenoid and disposed in the trench and proximate to the vertically extending contacts of the solenoid bobbin, the magnetic coupling member surrounding at least a portion of the central aperture; and a plunger extending into the central aperture, the plunger operable to rotate and move axially along a plunger axis between at least two positions, the plunger comprising:

a first component including a main body and a central slot within the main body;

a second component extending into the central slot, wherein the second component includes an engagement surface mechanically engaged with an inner surface of the central slot, wherein the second component includes a first section connected with a second section, wherein a width of the second section is greater than a width of the first section, wherein second component further includes a shoulder region between the first section and the second section, wherein the engagement surface comprises a knurled surface pattern immediately below the shoulder region, wherein the first component is made from a carbon steel, and wherein the second component is made from stainless steel, and wherein the stainless steel is in contact with a conductive plate having at least one contact; and an end cap coupled to a first end of the second component.

12. The solenoid electrical switch of claim 11, wherein the shoulder region engages a surface projection along the inner surface of the central slot.

13. The solenoid electrical switch of claim 12, the surface projection comprising a ledge extending radially towards the plunger axis.

14. The solenoid electrical switch of claim 11, wherein the plunger is magnetically attracted towards the magnetic coupling member.

* * * * *